US005173991A

United States Patent [19]

Carswell

[11] Patent Number: 5,173,991

[45] Date of Patent: Dec. 29, 1992

[54] DOOR CHECK HAVING A LINK COATED WITH MOLDABLE MATERIALS

[75] Inventor: David Carswell, Toronto, Canada

[73] Assignee: Multimatic Inc., Markham, Canada

[21] Appl. No.: 585,525

[22] Filed: Sep. 20, 1990

[30] Foreign Application Priority Data

Sep. 28, 1989 [CA] Canada ..... 614176

[51] Int. Cl.[5] ..... E05F 5/02; E05F 5/06; E05D 11/10; E05C 17/18

[52] U.S. Cl. ..... 16/86 A; 16/82; 16/325; 16/334; 16/344; 292/265; 70/93

[58] Field of Search ..... 16/82, 85, 86 A, 86 B, 16/86 C, 86 R, 325, 332, 333, 334, 335, 344, 345, 347, 71-74; 292/14, 15, 16, 17, 262, 265-278; 70/93, 102, 136

[56] References Cited

U.S. PATENT DOCUMENTS

| | | | |
|---|---|---|---|
| 1,646,580 | 10/1927 | Eastman | 16/82 |
| 2,043,976 | 6/1936 | Schonitzer . | |
| 2,268,942 | 1/1942 | Jacobs . | |
| 2,321,409 | 6/1943 | Moore | 16/85 |
| 2,465,088 | 3/1949 | Gussack | 16/86 A |
| 2,915,778 | 12/1959 | De Vito | 16/82 |
| 3,012,269 | 12/1961 | Bartel | 16/86 A |
| 3,224,033 | 12/1965 | Fannan, Jr. et al. | 16/82 |
| 3,561,036 | 2/1971 | Crane | 16/82 |
| 4,194,265 | 3/1980 | Zimmermann | 16/82 |
| 4,772,054 | 9/1988 | Schreiber et al. . | |
| 4,788,743 | 12/1988 | Okumura | 16/82 |
| 4,833,755 | 5/1989 | Bonin | 16/344 |

FOREIGN PATENT DOCUMENTS

| | | | |
|---|---|---|---|
| 2571416 | 4/1986 | France . | |
| 443606 | 3/1936 | United Kingdom | 292/270 |
| 604977 | 7/1948 | United Kingdom | 292/268 |
| 623135 | 5/1949 | United Kingdom | 292/266 |
| 1290737 | 9/1972 | United Kingdom | 292/262 |
| 1505703 | 3/1978 | United Kingdom . | |
| 2158871 | 11/1985 | United Kingdom | 292/267 |
| 2160584 | 12/1985 | United Kingdom . | |
| 2180590 | 4/1987 | United Kingdom | 292/267 |
| 2204638 | 11/1988 | United Kingdom | 16/82 |

*Primary Examiner*—Lowell A. Larson
*Assistant Examiner*—Thomas C. Schoeffler
*Attorney, Agent, or Firm*—Neil H. Hughes; Ivor M. Hughes

[57] ABSTRACT

A checking mechanism for a closure member and a frame, the closure member moveable in relation to the frame, the checking mechanism comprising a housing affixed to the closure member or the frame and having an opening therewith; a link member having a core and having two sides, the link member being fastened to either the frame or the closure member, the link member being moveable in relation to the housing and passing through the opening therewith; link engaging means secured with the housing proximate the opening at, at least one side of the link member, and retained in at least one compatible groove formed proximate at least one side of the link member for the positioning of the link member in relation to the housing, the grooves of the link member being formed by coating the core thereof with moldable material prior to assembly of the checking mechanism.

38 Claims, 7 Drawing Sheets

DOOR CHECK HAVING A LINK COATED WITH MOLDABLE MATERIALS

FIELD OF INVENTION

This invention relates to checking mechanisms for checking a closure member in relation to a frame. Specifically this invention finds application as a door check for a vehicle door.

BACKGROUND OF THE INVENTION

A multitude of checking devices are known in the prior art which retain a door such as a vehicle door in relation to a frame.

U.S. Pat. No. 2,043,976 issued on Jun. 9, 1936 to Schonitzer describes a door checking device having contained therein opposed ball members 30 contained in a cage means 31 as best seen in relation to FIG. 3. The ball members 30 are freely rotatable in the cage.

U.S. Pat. No. 2,268,942 issued on Jan. 6, 1942 to Jacobs describes a door check device as illustrated in relation to FIG. 3 having two rubber springs 14 retained in a housing 12. Associated with each spring is a retaining plate 16 having a socket 17 for receiving a ball bearing 18. The ball bearings are free to rotate in their respective sockets and therefore have rolling contact with an arm 7. The arm 7 is made from metal. It has a spring steel construction as seen best in FIG. 3.

Great Britain Patent Specification 1,505,703 published on Mar. 30, 1978 describes in two intermediate detent notches set in the opposing edges of a blade arm in order to allow a partially open position for the vehicle door.

U.S. Pat. No. 4,772,054 issued on Sep. 20, 1988 to Schreiber describes a check device including balls which are placed in relation to a spring mechanism having therebetween intermediate plates upon which the balls 13 and 14 engage. These intermediate plates 26 and 27 may be coated with plastic material in order to reduce the static friction between the ball bearings and these plates. Nowhere is it mentioned that the guide tracks 16 and 17 are formed from such resilient plastic materials.

Referring now to Great Britain Patent Application 2,160,584 disclosed by Morris and published on Dec. 24, 1985 there is disclosed a pair of rollers disposed within plastic roller carriers 8 as illustrated in relation to FIG. 1, having a housing 1 which are backed by confined rubber blocks 14.

French Patent Application 2,571,416 now issued following publication of the application on Apr. 11, 1986 to Yves Le Roy describes a door checking device having ball bearing means contained therein as best seen in relation to FIG. 2 and FIG. 3. A sliding bracket made of spring steel is provided which in cooperation with the spring steel check arm 2, as best seen in FIG. 1, provides an upper and a lower race within which the ball bearings will ride. However the structure includes the use of a sliding bracket 10 which has a groove having detents A2 and B2 therewith which work in cooperation with the detents A1 and B1 of the check arm 2. Nowhere within this publication is there taught the use of a check arm alone without the sliding bracket, the arm having grooves formed therewith and detents formed with the grooves which retains the ball in the groove without the need of a sliding bracket. Nowhere within the prior art is there found a checking mechanism which includes a link arm which is easily formed and yet includes all of the necessary detent recesses and cam surfaces.

Modern car door geometry and motion during opening and closing often dictates the need for a curved check arm to accommodate the motion of the door. However in providing a curved check arm in the checking mechanism the advantages of a straight check arm with all the forces resolved through the pivot and the ball are lost. Therefore in the necessity of providing the curved check arm a force coupling is introduced into the assembly which must be counteracted.

Nowhere within the prior art is there found a checking mechanism which includes a link arm which is easily formed and yet includes all of the necessary detent recesses and cam surfaces.

It is therefore an object of this invention to provide a check mechanism which includes a link arm moveable to a predetermined number of positions wherein the link arm includes at those positions detents which were formed by coating a core with moldable material.

It is another object of this invention to provide a mechanism which operates silently.

It is therefore an object of the invention to provide a check mechanism which includes a link arm moveable to a predetermined number of positions wherein the link arm includes at those positions detents which retain the door at predetermined positions.

It is a further object of this invention to provide a checking mechanism which includes a curved check arm, and a check mechanism, which restrains the check arm from moving laterally.

Further and other objects of this invention will become apparent to a man skilled in the art when considering the following summary of the invention and the more detailed description of the preferred embodiment illustrated herein.

SUMMARY OF THE INVENTION

According to one aspect of the invention there is provided a checking mechanism (for example a door check for a vehicle) for a closure member and a frame (preferably a vehicle door), the closure member moveable in relation to the frame, the checking mechanism comprising a housing affixed to the closure member or the frame and having an opening therewith; a link member having a preferably metal core and having two sides, the link member being fastened to either the frame or the closure member, the link member being moveable in relation to the housing and passing through the opening therewith; link engaging means secured with the housing proximate the opening at, at least one side of the link member, and retained in at least one compatible groove formed proximate at least one side of the link member for the positioning of the link member in relation to the housing; the link member preferably having detent means disposed therewith to retain the closure member at predetermined locations with respect to the frame, preferably the link member having at least one cam surface disposed proximate at least one side thereof proximate the groove to bias the link engaging means away from the link member, the grooves (and if present the cam surfaces and the detent means) of the link member being formed by coating the preferably metal core thereof with moldable material (preferably capable of withstanding normal contact with metal such as Milon by Dupont) prior to assembly of the checking mechanism.

In a preferred embodiment of the invention the link engaging means may comprise ball bearings. Preferably the ball bearings are retained in a plastic member disposed inside the housing, the plastic member having a substantially hemispherical recess therewith for retaining the ball bearing in contact with the groove. Preferably rubber cushions or other spring biasing means are provided with the plastic member within the housing.

In a preferred embodiment the detent means may comprise hemispherical recesses formed with the groove of the link member at predetermined locations. Preferably cam surfaces are formed with the at least one groove of the link member which causes the ball bearings to move towards or away from the recesses when the link arm moves through the housing as the closure member pivots from a closed to an open position. Preferably the material used is Milon of the Dupont Corporation or the like, having the characteristics to be moldable, and when molded to withstand the loading applied by the preferably metal ball bearing.

According to yet another aspect of the invention a link member for a checking member for a closure member affixed to a frame is provided, the link member comprising a preferably metal core and having two sides, the link member being fastened to either the frame or the closure member, the link member having at least one compatible groove formed proximate at least one side thereof, the link member preferably having detent means disposed therewith to retain the closure member at predetermined locations with respect to the frame, preferably the link member having at least one cam surface disposed proximate at least one side thereof proximate the groove, the grooves (and if present the cam surfaces and the detent means) of the link member being formed by coating the preferably metal core thereof with moldable material (preferably capable of withstanding normal contact with metal such as Milon of the Dupont Corporation or the like) prior to assembly of the checking mechanism.

A checking mechanism for a vehicle is preferred. By structuring the checking mechanism as described above in the embodiments of the invention, the link member may be formed with alternative functions thereon without the need to swage, sinter or form the link by costly metal working alternatives. By providing a strong core center the link is assured of continuous operation in the checking mechanism. The coating of the strong core with a hard plastic moldable material such as Milon or the like allows for the formation of the cam surfaces, grooves, hemispherical recesses, and shoulders, of the link member in a mold formed around the core.

According to one aspect of the invention there is provided a checking mechanism (for example a door check for a vehicle) for a closure member and a frame (preferably a vehicle door), the closure member moveable in relation to the frame, the checking mechanism comprising a housing affixed to the closure member or the frame and having an opening therewith; a link member having two sides, the link member being fastened to either the frame or the closure member, the link member being moveable in relation to the housing and passing through the opening therewith; link engaging means secured with the housing proximate the opening at, at least one side of the link member, and retained in at least one compatible groove formed proximate at least one side of the link member for the positioning of the link member in relation to the housing; preferably the link member having detent means disposed therewith to retain the closure member at predetermined locations with respect to the frame, preferably the link member having at least one cam surface disposed proximate at least one side thereof proximate the groove to bias the link engaging means away from the link member.

In a preferred embodiment of the invention the link engaging means may comprise ball bearings. Preferably the ball bearings are retained in a preferably plastic member disposed inside the housing, the member having a substantially hemispherical recess therewith for retaining the ball bearing in contact with the groove. Preferably rubber cushions or other resilient biasing means are provided with the member within the housing.

In a preferred embodiment the detent means may comprise hemispherical recesses formed with the groove of the link member at predetermined locations. Preferably cam surfaces are formed with the at least one groove of the link member which causes the ball bearings to move towards or away from the recesses when the link arm moves through the housing as the closure member pivots from a closed to an open position.

According to yet another aspect of the invention a link member for a checking member for a closure member affixed to a frame is provided, the link member comprising two sides and being fastened to either the frame or the closure member, the link member having at least one groove formed proximate at least one side thereof, the link member preferably having detent means disposed therewith to retain the closure member at predetermined locations with respect to the frame, preferably the link member having at least one cam surface disposed proximate at least one side thereof proximate the groove.

According to another aspect of the invention the checking mechanism may further comprise a link member having a preferably metal core and having two sides, at least one compatible groove formed proximate at least one side of the link member for the positioning of the link member in relation to the housing; the grooves (and if present the cam surfaces and the detent means) of the link member being formed by coating the preferably metal core thereof with moldable material (preferably capable of withstanding normal contact with metal such as Milon by Dupont prior to assembly of the checking mechanism.

According to another aspect of the invention the link member has a preferably metal core and has two sides, and at least one compatible groove formed proximate at least one side of the link member for the positioning of the link member in relation to the housing in use; the grooves (and if present the cam surfaces and the detent means) of the link member being formed by coating the preferably metal core thereof with moldable material (preferably capable of withstanding normal contact with metal such as Milon by Dupont) prior to assembly of the checking mechanism.

In a preferred embodiment the link member is curved to allow for the geometry and motion of the closure member such as a vehicle door. The groove is formed to provide lateral stability to the link member and to retain the link engaging means centrally in the groove. Any forces developed on the link member because of the curve in the link member are resolved through the pivot of the link member, as is the case when the link member is a straight noncurved member. However because of the curve these forces are therefore resolved into their components firstly through the center of the link engaging means and secondly resisted by the portions of the link member proximate the groove restraining the link engaging means from leaving the groove. It is this second component which must be compensated for in the design of the checking mechanism. In a preferred embodiment the link engaging means is a ball. Preferably the ball is of a diameter greater than the diameter of the groove which provides for the ball rolling and not sliding or slipping in the groove.

In a preferred embodiment of the invention the link engaging means may comprise ball bearings. Preferably the ball bearings are retained in a plastic member disposed inside the housing, the plastic member having a substantially hemispherical recess therewith for retaining the ball bearing in contact with the groove. Preferably rubber cushions or other resilient biasing means are provided with the plastic member within the housing.

In a preferred embodiment the detent means may comprise hemispherical recesses formed with the groove of the link member at predetermined locations. Preferably cam surfaces are formed with the at least one groove of the link member which causes the ball bearings to move towards or away from the recesses when the link arm moves through the housing as the closure member pivots from a closed to an open position. Preferably the material used is Milon of the Dupont Corporation or the like, having the characteristics to be moldable, and when molded to withstand the loading applied by the preferably metal ball bearing.

A checking mechanism for a vehicle is preferred. By structuring the checking mechanism as described above in the embodiments of the invention, the link member may be formed with alternative functions thereon.

In a preferred embodiment by providing a strong core center the link is assured of continuous operation in the checking mechanism. The coating of the strong core with a hard plastic moldable material such as Milon or the like allows for the formation of the cam surfaces, grooves, hemispherical recesses, and shoulders, of the link member in a mold formed around the core.

BRIEF DESCRIPTION OF THE DRAWINGS

The invention will now be illustrated with respect to the following drawings illustrating embodiments of the invention in which.

DETAILED DESCRIPTION OF PREFERRED EMBODIMENTS OF THE INVENTION

Figure 1:
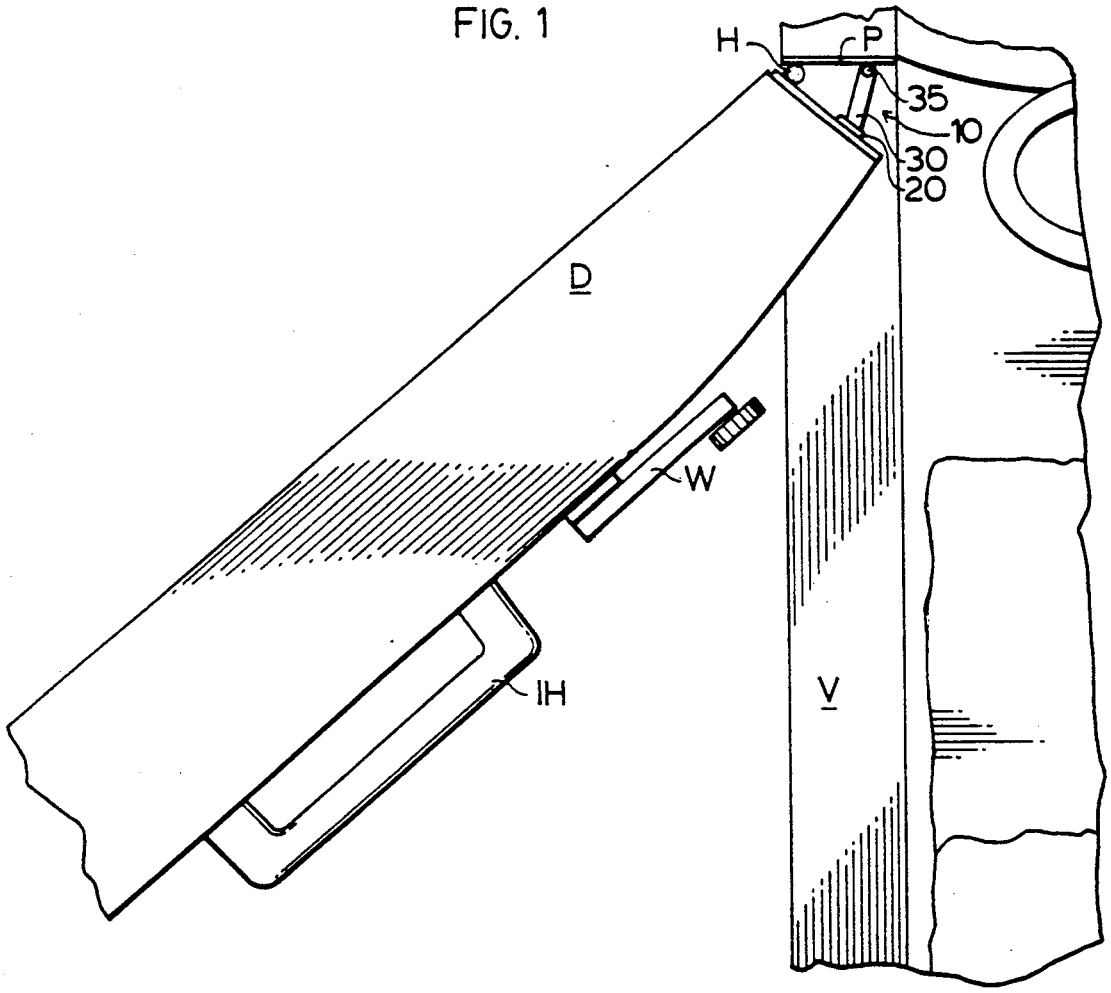
FIG. 1 is a schematic view of a preferred embodiment of the invention installed upon a vehicle.

Referring now to FIG. 1, there is illustrated in schematic view a door check device 10 mounted on the pillar P of a vehicle V from which is hingedly supported by a hinge H a door D having a window winder and a inside handle as is known in the art. The door check device 10 is mounted on the pillar P of vehicle V by a pin 35 connecting a link member 30 to a housing 20 installed within the end of a door D. In prior art door checks the link 10 is curved in shape to coincide with the path which the edge of the door adjacent the hinge H will travel with respect to link member 10. In prior art door checks a roller or alternative rolling device is use.

In the preferred embodiment of the invention the link member 10 is coated with a resilient yet hard moldable material such as Milon of Dupont Corporation or any other equivalent well wearing material.

Figure 2:
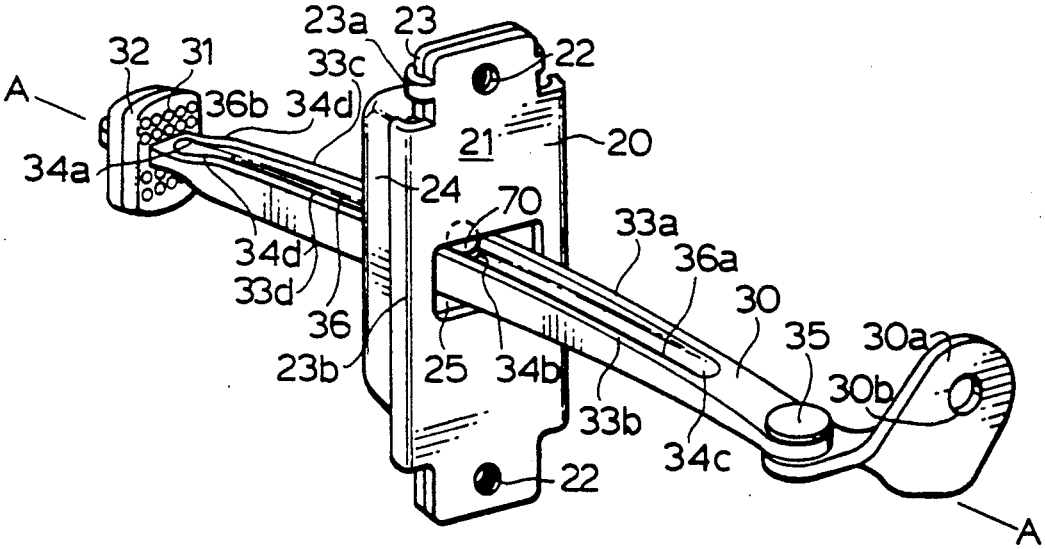
FIG. 2 is a perspective view of the check mechanism of FIG. 1 illustrated in a preferred embodiment of the invention.

Referring now to FIG. 2 there is illustrated in perspective the door check 10 separated from the door D of the vehicle V in order to describe the components thereof. Normally the housing 20 is inserted within the end of the door D of FIG. 1, much of which is not apparent to the observer. A bracket member **30*a* or the like is used and supported to the pillar P of FIG. 1 via a fastening device through the opening 30*b* of the bracket 30*a*. A pin 35 connects the bracket to the link member 30. The housing 20 is fastened by fastening screws 22*a* of FIG. 4 through the edge of the door adjacent the hinge in FIG. 1. The housing therefore is retained within the door and the link 30 moves within the housing to a number of detent positions described by the hemispherical recesses 34*a*, 34*b* and 34*c* which act as stop positions for the door as it pivots upon its hinge H as shown in FIG. 1. Disposed within the housing 20 within the opening 25 are ball bearings 70 as best seen in relation to FIG. 4 which move within the groove 36 formed on the link 30. At the end of the link member proximate the pin 35 there is located the detent recess 34*c*. The groove 36 has a inclined ramp or cam surface 36*a* disposed between the detent recesses 34*c* and 34*b*. The ball bearing will therefore in its motion be forced on an up hill climb in order to move from detent recess 34*c* to detent recess 34*a*. The groove 36** therefore defines a pass within which the roller bearing will travel allowing for the free articulation of the door and the response of the door check unit to such articulation.

In essence the ball bearing provides three dimension degrees of freedom to predetermined amounts for the assembly 10. The prior art devices have rollers which only allow for 2 degrees of freedom in the assembly and results in a fair amount of grinding of the housing adjacent the edges or shoulders of the link member.

The instant invention includes shoulders **33*a* and 33*b* which also have inclined surfaces disposed thereupon between the detent recess 34*c* and 34*b* in order to retain the ball bearing correctly in the groove 36. At the other end of the link member 30 remote the pin 35 is disposed a bumper pad 31 and an anchoring member 32 which insures the quiet operation of the motion of the link member from its position when the ball is disposed within the recess 34*c* and the door D of FIG. 1 is closed, to a position wherein the door is at its fullest articulated extent and the ball 70 is located in the locking detent recess 34*a* proximate the bumper 31. The shoulders 33*c* and 33*d* retain the ball as it moves toward the detent recess 34***a* and the groove 36 with a compression on the ball a predetermined amount equivalent to substantially the compression prior to entering the detent recess 34*b*. Prior to entering the recess 34*a* a downward sloped portion 36*b* of the groove provides for a quick capture of the ball 70 within the detent recess 34*a*. The shoulder 34*d* ensure that the ball is retained in the correct position in relation to the housing. Thus, as the link 30 moves through the opening 25 of the housing 20 the ball bearing 70 will adopt in three essential positions in recesses 34*c*, 34*b* and 34*a* depending on whether the door is closed, partially open or fully open.

Figure 4:
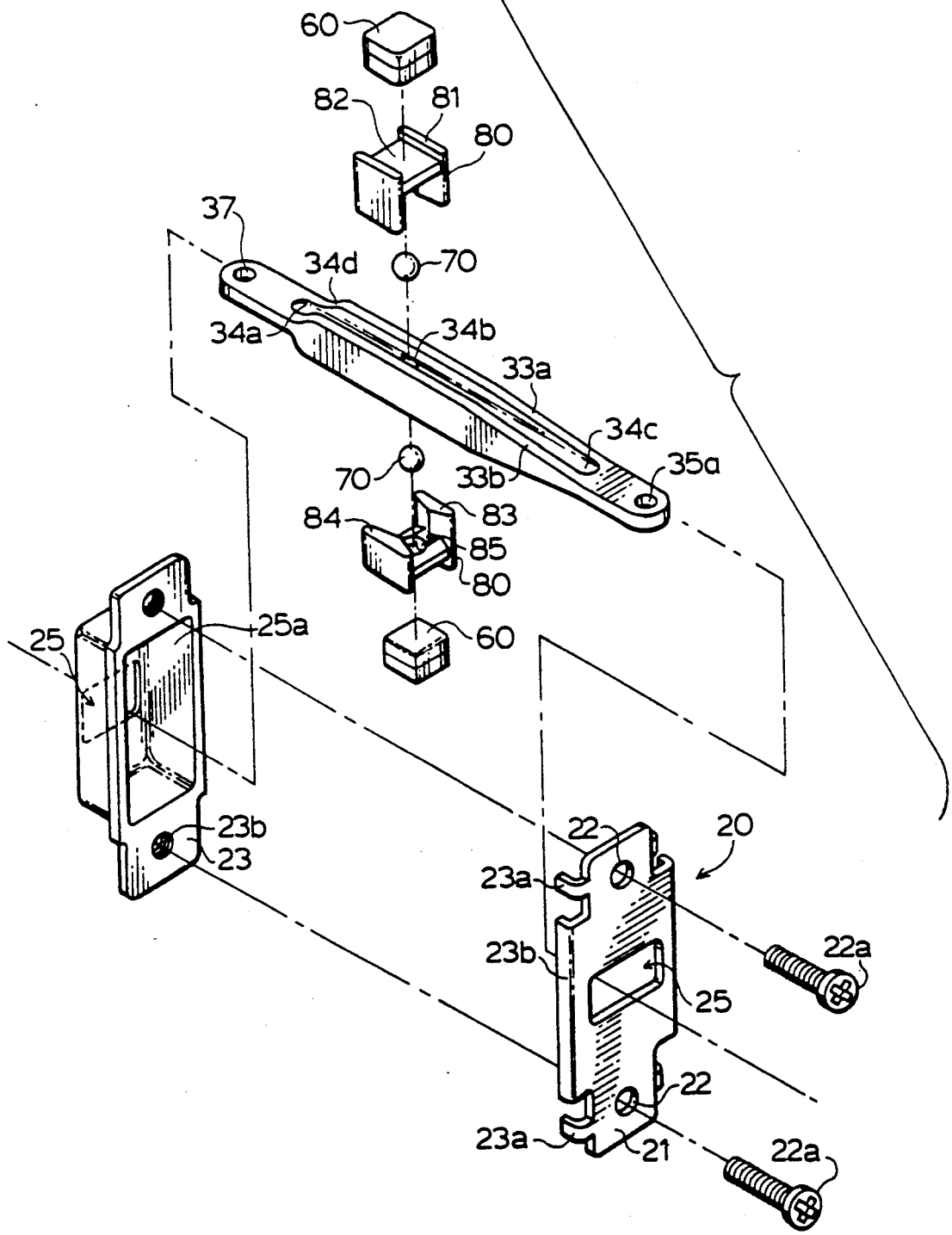
FIG. 4 is an exploded perspective view of the checking device of FIG. 2 illustrated in a preferred embodiment of the invention.

Referring now to FIG. 4 there is illustrated an exploded perspective view of the door check assembly 10 of FIG. 2. All of the elements described in relation to FIG. 2 are present with the exception that the interior of the housing is now exploded for more detaled explanation. A plastic member 80 having appendages 83 and 84 and feet 81 are disposed within the housing. Disposed between the feet 81 of the plastic member is a resilient spring like member 60 which provides the ability to store energy when the ball bearing is pushed away from the link member 30 by the cam surfaces 36*a* in the groove 36. A return spring 60 will therefore allow the energy stored to be returned to move the ball bearing into, for example the recess of 34*a* when free to do so. The housing 80 is retained on each side of the link member 30. There is a compatible groove structure formed on the link member 30 to allow the movement of two ball bearings 70 within each groove 36. Disposed within each housing 80 is a hemispherical recess 85 which contains the ball bearing in use and provides a capturing of the ball bearing between the hemispherical recess 85 and the groove 36 of the link member 30.

The resilient members 60 and the plastic carrier portions 80 are disposed within the housing portion 23 within the opening 25*a*. The front bracket 21 is then connected to the housing portion 23, the eclipse 23*a* and flange 23*b* after the link member is passed through the openings 25 of the housing. The fasteners 22*a* then fasten the housing adjacent the edge of the door near the hinge assembly as illustrated in FIG. 1.

Figure 3:
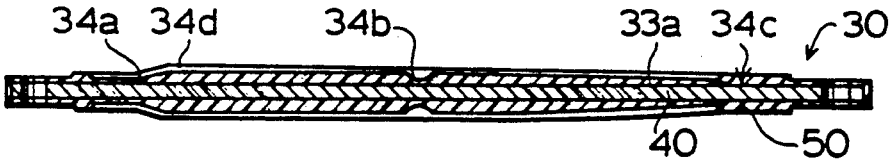
FIG. 3 is a cross-section view of the link arm of FIG. 2 illustrated in a preferred embodiment of the invention.

Referring now to FIG. 3, in order to advantageously form a link member 30 a core member is formed 40 being a generally flat structure preferably made from metal and having openings 37 and 35*a* disposed at the ends. The link member is then coated with a tough, hard, moldable material such as Milon of the Dupont Corporation in order to form the groove 36 the shoulders 33*a*, 33*b*, 33*c* and 33*d*, the recesses 34*a*, 34*b* and 34*c*, the cam surfaces 36*a* and 36*b* and the inclined surfaces of the shoulders 33*a*, 33*b*, 33*c* and 33*d*. In prior art structures the surfaces are formed from spring steel or swaged metal rods. In providing the moldable material covering the inner core a easily manufactured link member is formed enhancing the silent operation of the ball bearing and allowing for the easy formation of alternative functions not easily formed from spring steel or swaged metal rods.

In an alternative embodiment of the invention the structure of FIG. 3 is formed with a non-metallic core having metal like properties.

Referring to FIG. 3 there is found a core 40 over which a multiple layer 50 is disposed forming the recesses 34*a*, 34*b* and 34*c* therein which are generally hemispherical in shape along with the shoulders 33*a*, 33*b* and 33*c* and the groove 36, 36*a* and 3*b*.

Figure 5:
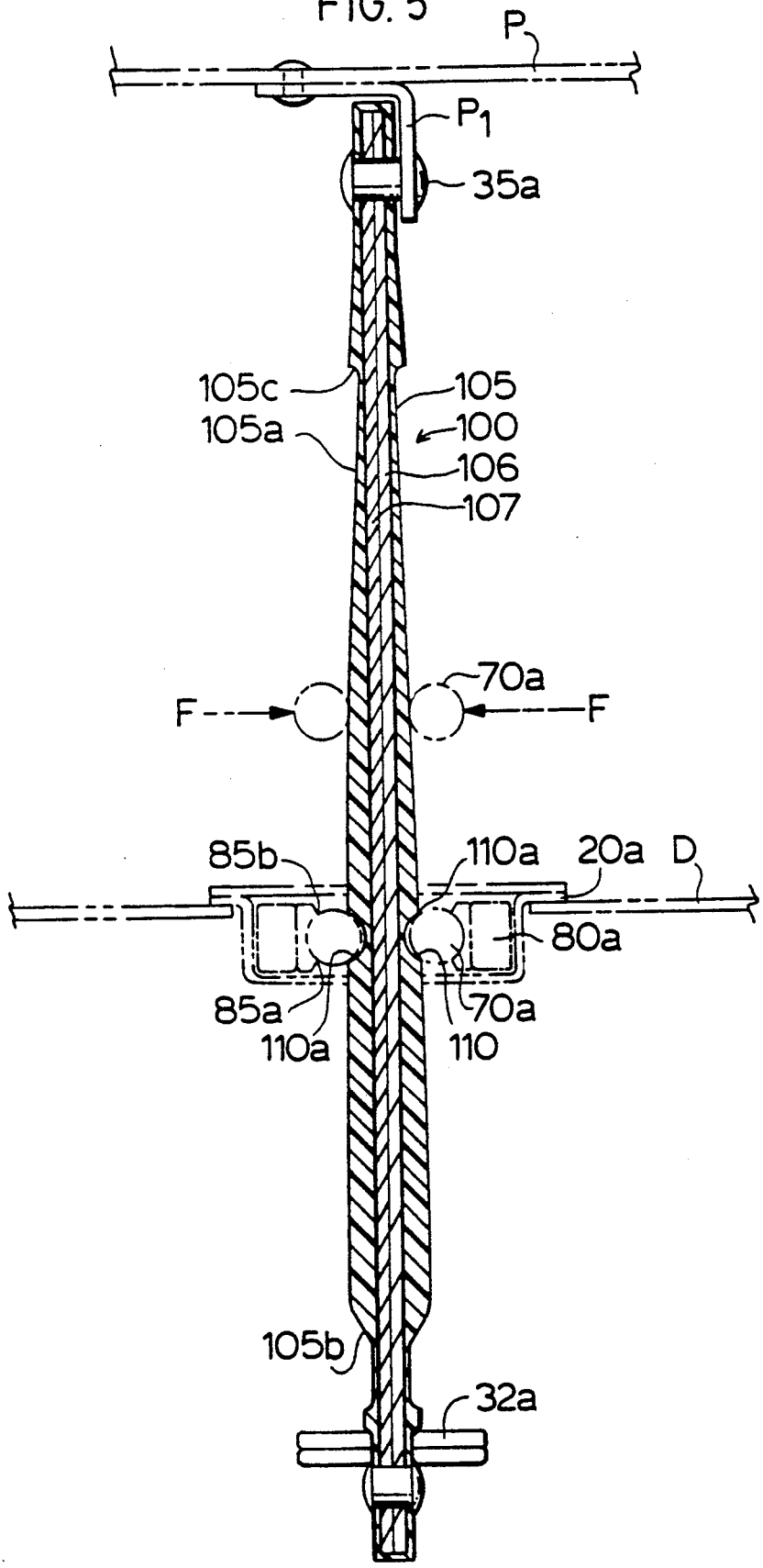
FIG. 5 is a cross sectional view of a preferred embodiment of the supplementary disclosure of the invention.

Referring now to FIG. 5, there is illustrated in cross-section a check mechanism 100 which is affixed to a door D and the column of a vehicle P. The check arm 105 is formed from metal, for example by stamping and is pivoted at the end proximate the pillar P via a pivot pin 35A which extends through an opening through the generally L-shaped flanged Pl and through an opening through the check arm 105. A housing 20A is secured to the door D by fasteners (not shown) by conventional methods. The check arm 105 therefore is free at the end proximate the bumper 32A to move within the housing 20A. The housing 20A includes resilient bumpers 80A and plastic members 85A which include a recess 85B which is hemispherical in form. The resilient member 80A therefore provides sufficient pressure on the ball bearing 70A through the member 85A retained in the hemispherical recess 85B to respond to a force tending to compress the resilient member or cushion 80A, by exerting an equal and opposite force on the ball bearing toward the link member 105. The link member 105 is formed from metal by a stamping process including laser welding and has formed therewith a ramp surface 105A upon which the ball bearing 70A rolls. Further, recesses 110 are formed at convenient locations along the check arm 105 to create hemispherical recesses in which the ball bearing may rest at various positions along the check arm 105. As is clearly pointed out in the FIG. 5 illustration, the check arm becomes greater in cross-section proximate the end having the bumper 32A then it is proximate the end of the pivot pin 35A. Therefore the ball bearing in moving from shoulder 105C toward 105B tending to create a force on the ball bearing which assists in maintaining the ball bearing in the groove 110.

Figure 7:
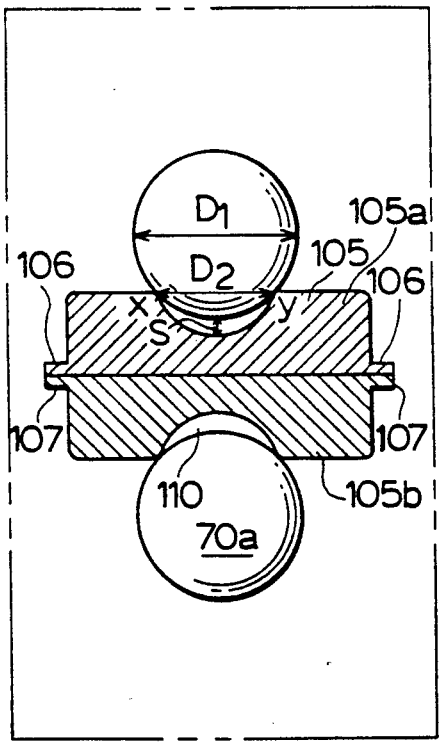
FIG. 7 is a cross-section view of the link arm of FIG. 5 illustrated in a preferred embodiment of the invention.

As best seen in relation to FIG. 7, the groove 110 has a diameter D2 less than the diameter of the ball bearing 70A D1. Therefore the ball bearing touches the edges of the groove proximate points X and Y of check arm 105. A space S therefore is left between the bottom of the ball bearing and the bottom of the recess. This structure assists the ball bearing in rolling within the groove 110 rather than sliding in the groove 110. The sliding motion tends to wear out the check arm quickly and it is a feature which is very undesirable. Therefore the above-mentioned structure of the undersized groove is provided. The check arm 105 as best seen in FIG. 7 includes two portions 105A and 105B which are made from metal and are joined together proximate flanges 106 and 107 via laser welding. The hemispherical recesses as best seen in FIG. 5 are formed in the members 105A and 105B by a stamping process prior to assembly of the check arm 105. The groove 110 is also formed by a stamping process. It of course is possible that the check arm 105 may be formed by any convenient metal working process such as sintering or the like in order to provide the necessary grooves and recesses within its exterior surface.

Figure 6:
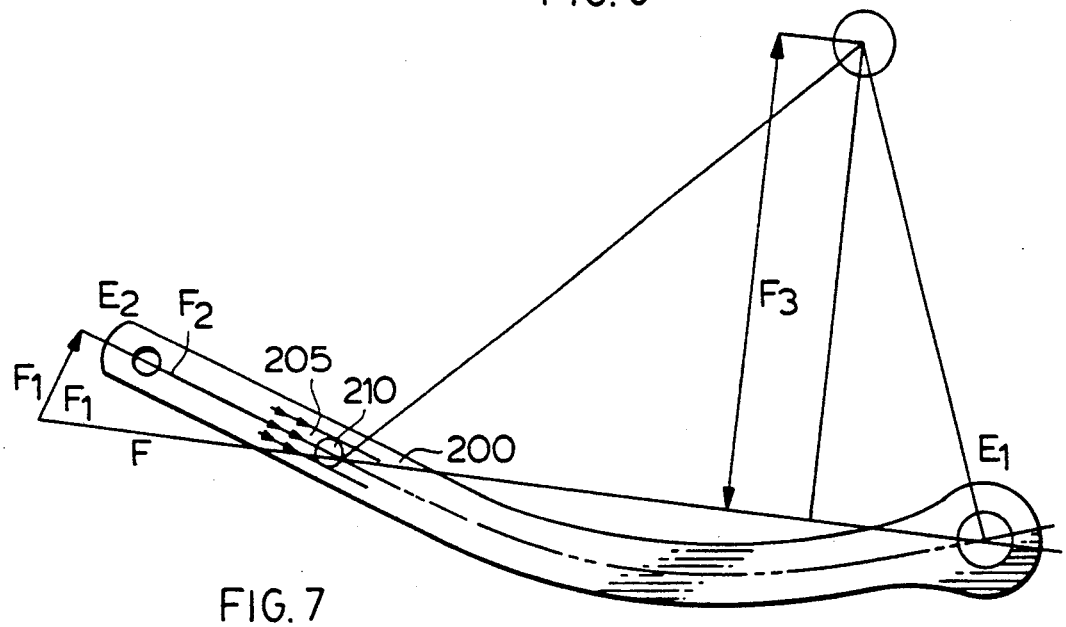
FIG. 6, and 6A–6D are top views of a curved check arm used in a check mechanism illustrated in a preferred embodiment of the invention.

Referring now to FIG. 6, there is illustrated a curved check arm which may be formed from either metal as described in relation to FIG. 5 or be formed with a strong core coated in Milon wherein the Milon forms the necessary groove and hemispherical recess. For the instance illustrated in FIG. 6, it is assumed that any convenient structure would apply. The check arm therefore 200 is formed having a groove 205 within which a ball bearing 210 rides. Any convenient positioning of ramps, recess and shoulders such as in FIG. 5 may be provided. As the ball bearing rolls towards the end El because of the curved nature of the check arm, a force coupling is exerted upon the ball bearing. The force coupling is a result of the resolution of the force F which passes through the center of the ball bearing and the center of the pivot at the end El. A force coupling therefore Fl and F2 are exerted upon the ball, the force Fl tending to remove the ball bearing laterally away from the groove. The groove therefore must be sized correctly to withstand this force F1 upon the ball bearing 210 and apply an equal and opposite force in the opposite direction as the doors move to maintain the ball bearing in its groove.

In testing such a curved check arm in use it has been established that a force F3 varies with the positioning of the door and the ball bearing along the curved arm. These positions are best shown in relation to FIGS. 6A through 6D.

Figure 6A:
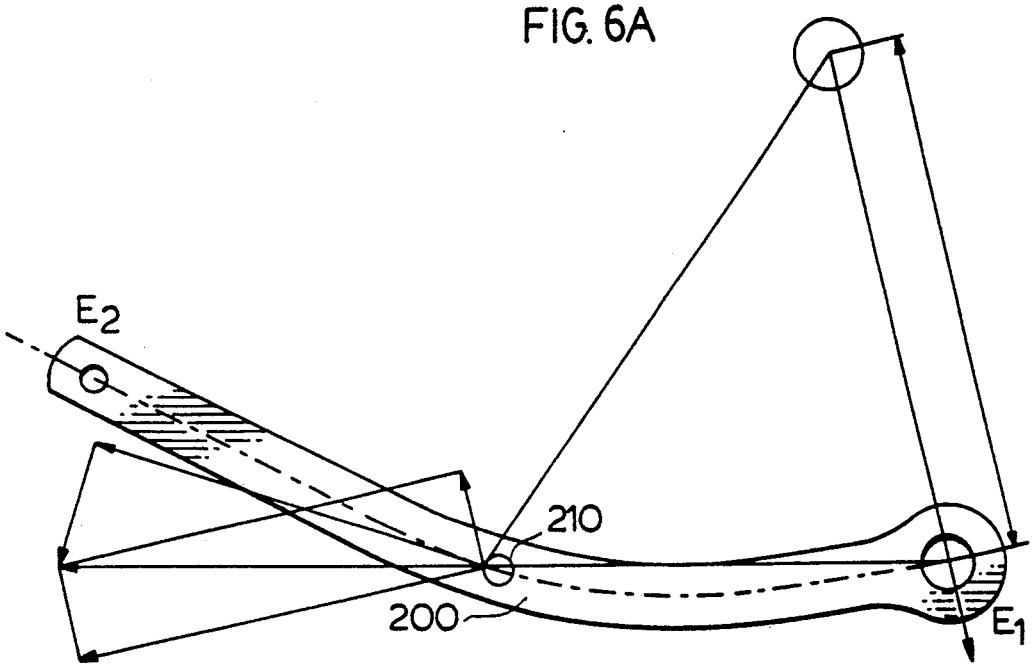
Figure 6B:
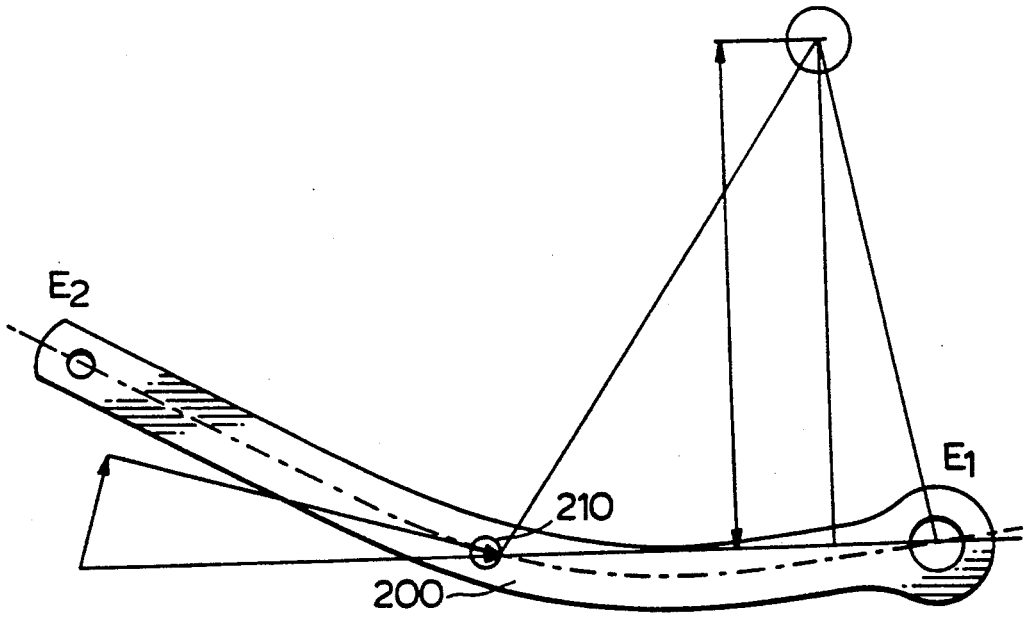
Figure 6C:
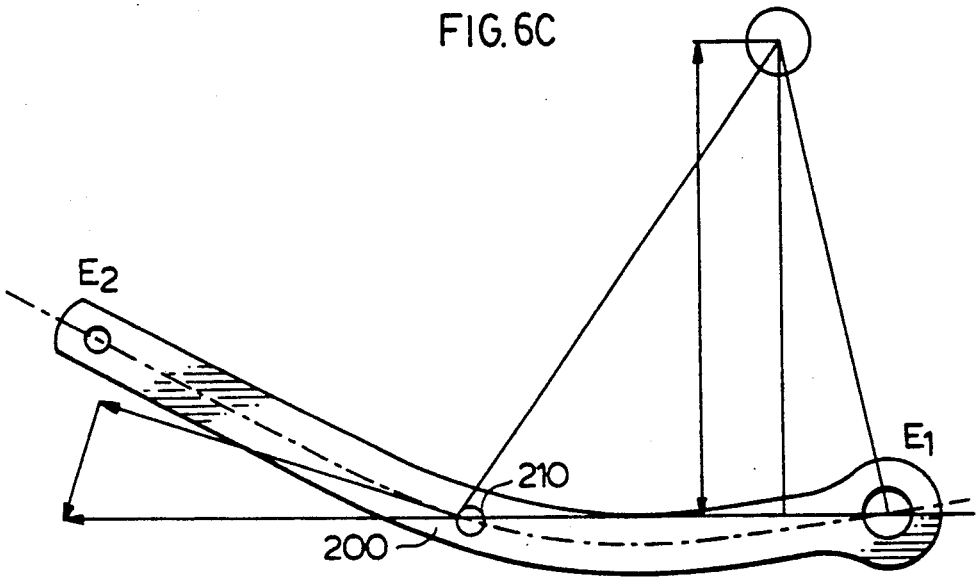
Figure 6D:
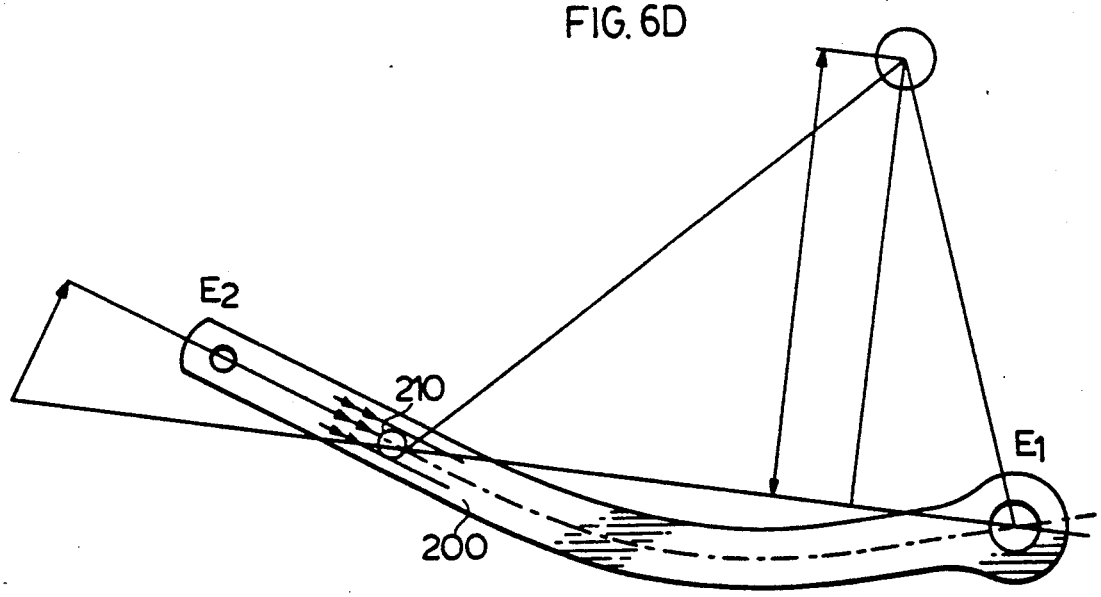

Referring now to FIGS. 6A through 6D specific values for each of the forces F, F1, F2 and F3 are illustrated indicating the values in Newton meters upon the check arm 200. In each of the illustrations FIG. 6A through FIG. 6D the values of F, F1, F2 and F3 are illustrated for the position of the ball bearing. For example, FIG. 6A illustrates the ball bearing moving during an opening position taken in snap shot and illustrating the resolved force of 76.7 Nm as a force tending to remove the ball bearing from the recess in the check arm 200. In FIG. 6B a force of 75.1 Nm is exerted upon the ball bearing when the door is closed and the ball bearing is in a very similar position to the position of FIG. 6A. In FIG. 6C it was determined that a force of 74.8 Nm is exerted upon the ball in the direction illustrated. Finally, in FIG. 6D a force of 71.9 Nm is exerted upon the ball when the ball is proximate the end E2.

Therefore, the check arm must be designed because of the curved geometry of the check arm resulting from the curved geometry of the door to withstand these forces. The recess therefore must resist this force coupling and the tendency for the ball bearing to dislodge from the recess 110 as best seen in FIG. 7.

Figure 8:
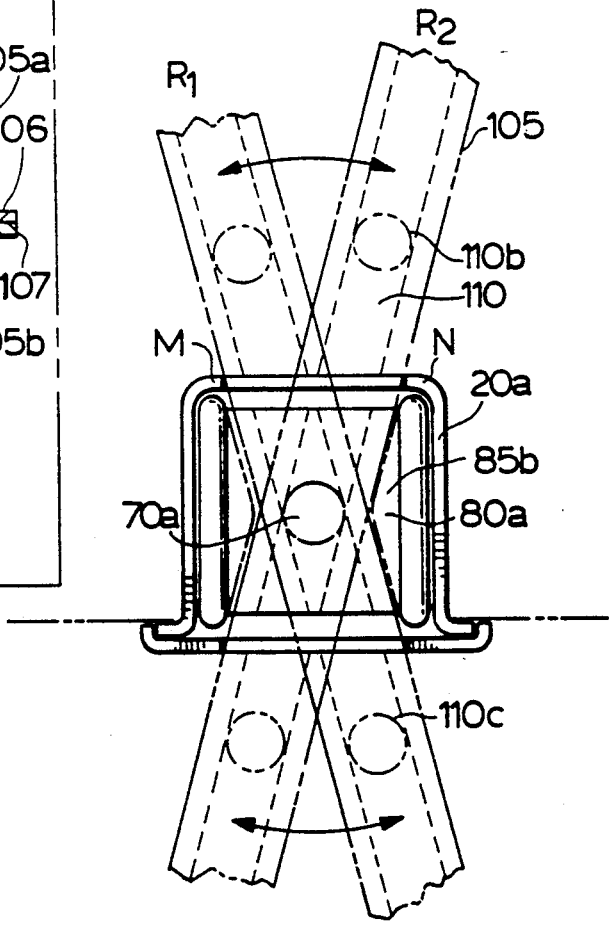
FIG. 8 is a top view of the checking device of FIG. 5 illustrated in a preferred embodiment of the invention.

Referring now to FIG. 8, there is illustrated the housing 20A within which the check arm moves as described in relation to FIG. 5. The check arm in this example is the straight check arm of FIG. 5 but may equally be the curved check arm of FIG. 6. It may be because of the geometry of the door that the check arm will move from a position R1 to R2 as it moves through the housing 20A. The resilient bumper 80A and the plastic retainer 85A retains the ball bearing within the recess 110 within the hemispherical recesses or detents 110A (not shown) which coincides with the position of the ball bearing 70A, 110B and 110C. It is important to have the ball bearing retained in the grooved in order to prevent the scoring of the housing and the link arm proximate the positions M and N of the housing 20A. Prior art structures which include rollers or the like have caused scoring at these positions because the force F3 of FIG. 6 tends to move the check arm laterally toward the housing. It is the intention and object of this invention to prevent the lateral movement of the check arm however formed or however shaped to not abut the edge of the housing 20A and score the check arm and the housing thereat. It is imperative therefore that the groove and the recesses be properly sized to accommodate the ball bearing and that the forces be fully considered to prevent this lateral movement.

As many changes can be made to the preferred embodiment without departing from the scope thereof; it is intended that all material contained herein be interpreted as illustrative of the invention and not in a limiting sense.

The embodiments of the invention in which an exclusive property or privilege is claimed are as follows:

1. A link member for a checking member for a closure member affixed to a frame is provided, the checking member including a housing and link engaging means, the link member comprising two sides and being fastened to either the frame or the closure member, the link member having at least one groove formed proximate at least one side thereof, the link member having detent means disposed therewith to retain the closure member at predetermined locations with respect to the frame, the link member having at least one cam surface disposed proximate at least one side thereof proximate the at least one groove to bias the link engaging means away from the link member.

2. The link member of claim 1 wherein the link member has a core and has two sides, and at least one compatible groove formed proximate at least one side of the link member for positioning the link member in relation to the housing in use; the link member being formed by coating the core thereof with moldable material prior to assembly of the checking member.

3. The link member of claim 2 wherein the moldable material is capable of withstanding normal contact with metal.

4. The link member of claim 1 or 2 wherein cam surfaces are formed with the at least one groove of the link member which causes the ball bearing to move towards or away from the detent means when the link arm moves through the housing as the closure member pivots from a closed to an open position.

5. The link member of claim 1 or 2 wherein the detent means further comprise hemispherical recesses formed with the at least one groove of the link member at predetermined locations.

6. The link member of claim 5 wherein cam surfaces are formed with the at least one groove of the link member which causes the ball bearing to move towards or away from the recesses when the link member moves through the housing as the closure member pivots from a closed to an open position.

7. The link member of claim 1 or 2 wherein said link member is curved to allow for the geometry and motion of the closure member, the at least one groove being formed to provide lateral stability to the link member and to retain the link engaging means centrally in the at least one groove, any forces developed on the link member because of the curve in the link member being resolved through a pivot of the link member, because of the curve of the link member these forces are therefore resolved into normal components firstly through a center of the link engaging means and secondly resisted by the link member proximate the at least one groove restraining the link engaging means from leaving the at least one groove.

8. The link member of claim 7 wherein the detent means further comprise hemispherical recesses formed with the at least one groove of the link member at predetermined locations.

9. The link member of claim 8 wherein cam surfaces are formed with the at least one groove of the link member which causes the ball bearing to move towards or away from the recesses when the link member moves through the housing as the closure member pivots from a closed to an open position.

10. The link member of claim 7 wherein the link engaging means is a ball bearing.

11. The link member of claim 10 wherein the detent means further comprise hemispherical recesses formed with the at least one groove of the link member at predetermined locations.

12. The link member of claim 10 wherein the ball bearing is retained in a plastic member disposed inside a housing, the plastic member having a substantially hemispherical recess therewith for retaining the ball bearing in contact with the at least one groove.

13. The link member of claim 12 wherein rubber cushions or other resilient biasing means are provided with the plastic member within the housing.

14. The link member of claim 10 wherein the ball bearing is of a diameter greater than the at least one groove, which provides for the ball bearing rolling and not sliding or slipping in the at least one groove.

15. The link member of claim 14 wherein the detent means further comprise hemispherical recesses formed with the at least one groove of the link member at predetermined locations.

16. The link member of claim 14 wherein the ball bearing is retained in a plastic member disposed inside a housing, the plastic member having a substantially hemispherical recess therewith for retaining the ball bearing in contact with the at least one groove.

17. The link member of claim 16 wherein rubber cushions or other resilient biasing means are provided with the plastic member within the housing.

18. A link member for a checking mechanism for a closure member affixed to a frame, the checking mechanism including link engaging means, the link member comprising a core and having two sides, the link member being fastened to either the frame or the closure member, the link member having at least one compatible groove formed proximate at least one side thereof, the link member being formed by coating thereof with moldable material prior to assembly of the checking mechanism, wherein the link member ha disposed therewith detent means to retain the closure member at predetermined locations with respect to the frame, wherein the link member has at least one cam surface disposed proximate at least one side thereof proximate the at least one groove to bias the link engaging means away from the link member.

19. The link member of claim 18, wherein the core is metal.

20. The link member of claim 18, wherein the coating is capable of withstanding normal contact with metal.

21. A checking mechanism for a closure member and a frame, the closure member moveable in relation to the frame, the checking mechanism comprising a housing affixed to the closure member or the frame and having an opening therewith; a link member having two sides, the link member being fastened to either the frame or the closure member, the link member being moveable in relation to the housing and passing through the opening therewith; link engaging means secured with the housing proximate the opening at, at least one side of the link member, and retained in at least one compatible groove formed proximate at least one side of the link member for positioning the link member in relation, wherein the link member has detent means disposed with the at least one groove to retain the closure member at predetermined locations with respect to the frame, wherein the link member has at least one cam surface disposed proximate at least one side thereof proximate the groove to bias the link engaging means away from the link member.

22. The checking mechanism of claim 21 further comprising a link member having a core and having two sides, at least one compatible groove formed proximate at least one side of the link member for positioning the link member in relation to the housing; the link member being formed by coating the core thereof with moldable material prior to assembly of the checking mechanism.

23. The checking mechanism of claim 22 wherein the moldable material is capable of withstanding normal contact with metal.

24. The check mechanism of claim 21 wherein the link engaging means further comprise ball bearings.

25. The checking mechanism of claim 24 wherein cam surfaces are formed with the at least one groove of the link member which causes the ball bearings to move towards or away from the detent means when the link member moves through the housing as the closure member pivots from a closed to an open position.

26. The checking mechanism of claim 24 wherein the detent means further comprise hemispherical recesses formed with the groove of the link member at predetermined locations.

27. The checking mechanism of claim 26 wherein cam surfaces are formed with the at least one groove of the link member which causes the ball bearing to move towards or away from the recesses when the link are moves through the housing as the closure member pivots from a closed to an open position.

28. The checking mechanism of claim 24 wherein the ball bearings are retained in a retaining member disposed inside the housing, the retaining member having a substantially hemispherical recess therewith for retaining the ball bearings in contact with the groove.

29. The checking mechanism of claim 28 wherein cam surfaces are formed with the at least one groove of the link member which causes the ball bearings to move towards or away from the detent means when the link member moves through the housing as the closure member pivots from a closed to an open position.

30. The checking mechanism of claim 28 wherein rubber cushions or other resilient biasing means are provided with the member within the housing.

31. The checking mechanism of claim 30 wherein cam surfaces are formed with the at least one groove of the link member which causes the ball bearing to move towards or away from the detent means when the link member moves through the housing as the closure member pivots from a closed to an open position.

32. A checking mechanism for a closure member and a frame, the closure member moveable in relation to the frame, the checking mechanism comprising a housing affixed to the closure member or the frame and having an opening therewith; a link member having a core and having two sides, the link member being fastened to either the frame or the closure member, the link member being moveable in relation to the housing and passing through the opening therewith; link engaging means secured with he housing proximate the opening at, at least one side of the link member, and retained in at least one compatible groove formed proximate at least one side of the link member for positioning the link member in relation to the housing, the at least one groove of the link member being formed by coating the core thereof with moldable material prior to assembly of the checking mechanism, the link member having detent means disposed with the at least one groove thereof to retain the closure member at predetermined locations with respect to the frame, the link member having at least one cam surface disposed proximate at least one side thereof proximate the at least one groove to bias the link engaging means away from the link member.

33. The checking mechanism of claim 32 wherein the detent means further comprise hemispherical recesses formed with the groove of the link member at predetermined locations.

34. The checking mechanism of claim 32 wherein the link member has a metal core.

35. The checking mechanism of claim 32 or 34, wherein the link engaging means further comprise ball bearings.

36. The checking mechanism of claim 35, wherein the detent means further comprise hemispherical recesses formed with the groove of the link member at predetermined locations.

37. The checking mechanism of claim 35, wherein the all bearings are retained in a plastic member disposed inside the housing, the plastic member having a substantially hemispherical recess therewith for retaining the ball bearing in contact with the groove.

38. The mechanism of claim 37, wherein rubber cushions or other spring biasing means are provided with the plastic member within the housing.

* * * * *